US009561918B2

(12) United States Patent
Yamaguchi

(10) Patent No.: US 9,561,918 B2
(45) Date of Patent: Feb. 7, 2017

(54) PAPER STACKER AND IMAGE FORMING APPARATUS

(71) Applicant: KYOCERA Document Solutions Inc., Osaka (JP)

(72) Inventor: Yoshihiro Yamaguchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/559,043

(22) Filed: Dec. 3, 2014

(65) Prior Publication Data

US 2015/0158682 A1 Jun. 11, 2015

(30) Foreign Application Priority Data

Dec. 6, 2013 (JP) ..... 2013-252914

(51) Int. Cl.
*B65H 1/00* (2006.01)
*B65H 1/14* (2006.01)
(Continued)

(52) U.S. Cl.
CPC ..... *B65H 1/14* (2013.01); *B65H 1/266* (2013.01); *B65H 3/66* (2013.01);
(Continued)

(58) Field of Classification Search
CPC ..... B65H 2701/113; B65H 2701/1315; B65H 2511/12; B65H 2405/1144; B65H 2405/11425; B65H 2405/1142; B65H 1/00; B65H 2405/00; B65H 2405/1116; B65H 2405/112; B65H 2405/113; B65H 2405/114; B65H 2511/10
(Continued)

(56) References Cited

U.S. PATENT DOCUMENTS 4,032,136 A * 6/1977 Komaba et al. ..... 271/160
7,661,671 B2 * 2/2010 Yamazaki ..... B65H 29/246 271/211
(Continued)

FOREIGN PATENT DOCUMENTS

JP 4-23742 * 1/1992
JP 5-319584 * 12/1993
(Continued)

OTHER PUBLICATIONS

An Office Action; "Notice of Reasons for Rejection," issued by the Japanese Patent Office on Mar. 29, 2016, which corresponds to Japanese Patent Application No. 2013-252914 and is related to U.S. Appl. No. 14/559,043.

*Primary Examiner* — Thomas Morrison
(74) *Attorney, Agent, or Firm* — Studebaker & Brackett PC

(57) ABSTRACT

An paper stacker includes a side fence and a lift plate. The side fence extends in a stacking direction and is configured to regulate a position in a width direction of paper. The lift plate is capable of moving the paper to a paper feed point. The side fence includes a main body, a swell segment swelling from the main body toward an edge of the paper below the paper feed point, and an urging segment including an urging surface portion above the swell segment. The urging surface portion is capable of moving toward the edge of the paper to urge the edge of the paper at the paper feed point.

17 Claims, 8 Drawing Sheets

(51) Int. Cl.
*B65H 1/26* (2006.01)
*B65H 3/66* (2006.01)

(52) U.S. Cl.
CPC ..... *B65H 2301/4222* (2013.01); *B65H 2405/1142* (2013.01); *B65H 2405/15* (2013.01)

(58) Field of Classification Search
USPC ..... 271/171
See application file for complete search history.

(56) References Cited

U.S. PATENT DOCUMENTS

| | | | | |
|---|---|---|---|---|
| 8,317,189 | B2 * | 11/2012 | Ueda et al. | 271/171 |
| 2004/0188924 | A1 * | 9/2004 | Ito | 271/171 |
| 2012/0119434 | A1 * | 5/2012 | Ueda et al. | 271/147 |
| 2013/0214483 | A1 * | 8/2013 | Hirahara | 271/264 |

FOREIGN PATENT DOCUMENTS

| | | | |
|---|---|---|---|
| JP | H09-040199 | A | 2/1997 |
| JP | H09-235024 | A | 9/1997 |
| JP | 2010-202410 | * | 9/2010 |

* cited by examiner

PAPER STACKER AND IMAGE FORMING APPARATUS

INCORPORATION BY REFERENCE

The present application claims priority under 35 U.S.C. §119 to Japanese Patent Application No. 2013-252914, filed Dec. 6, 2013. The contents of this application are incorporated herein by reference in their entirety.

BACKGROUND

The present disclosure relates to paper stackers and image forming apparatuses.

In general, image forming apparatuses including copiers, printers, etc. include a paper stacker on which paper is stackable. An image is formed on the paper picked up from the paper stacker. Typically, an image forming apparatus forms an image on paper in a manner that when the paper stacker lifts up the paper stacked thereon, and a paper feed roller picks up the topmost paper, followed by formation of the image on this paper by an image forming section.

However, when the picked-up paper is displaced, the image may be formed at a displaced location on the paper. In order to tackle this disadvantage, a paper feeder (paper stacker) has been proposed that is provided with an abutting member to regulate the position of the paper in picking up. In this paper feeder, the lifted-up paper abuts on the abutting member and then is fed, while the abutting member regulates the position of the paper. Accordingly, displacement of fed paper can be reduced.

SUMMARY

On a paper stacker according to the present disclosure, paper is stackable in a stacking direction. The paper stacker includes a side fence and a lift plate. The side fence extends in a stacking direction and is configured to regulate a position in a width direction of the paper. The lift plate is capable of moving the paper to a paper feed point. The side fence includes a main body, a swell segment, and an urging segment. The swell segment swells from the main body toward an edge of the paper below the paper feed point. The urging segment includes an urging surface portion above the swell segment. The urging surface portion is capable of moving toward the edge of the paper to urge the edge of the paper at the paper feed point.

An image forming apparatus according to the present disclosure includes the above paper stacker and an image forming section configured to form an image on the paper having been stacked on the paper stacker.

DETAILED DESCRIPTION

Embodiments of a paper stacker and an image forming apparatus according to the present disclosure will be described below with reference to the accompanying drawings. It is noted that the present disclosure is not limited to the following embodiments.

Figure 1:
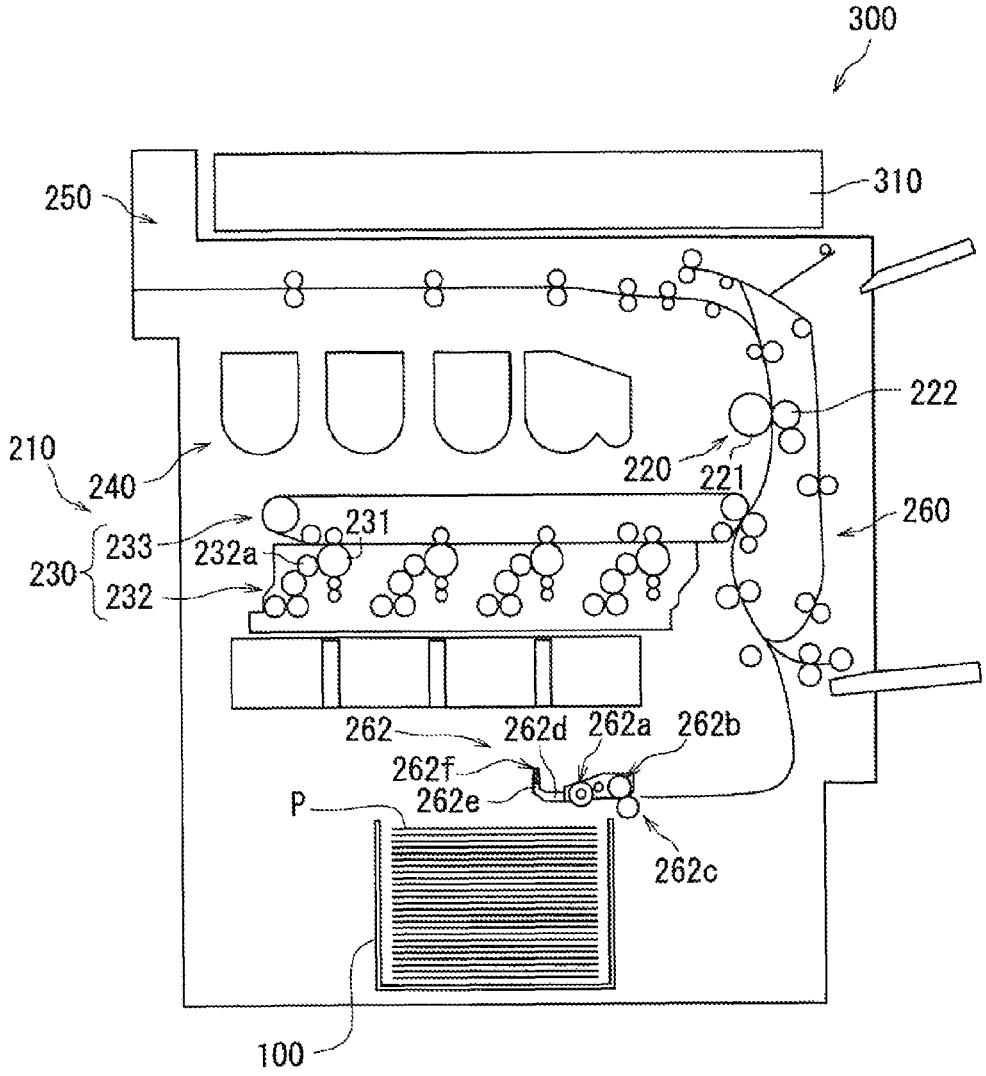
FIG. 1 is a schematic illustration showing an image forming apparatus according to an embodiment of the present disclosure.

With reference to FIG. 1, an image forming apparatus 300 according to the present embodiment will be described below. The image forming apparatus 300 includes a paper stacker 100 and an image forming section 210. On the paper stacker 100, paper P is stackable. The image forming section 210 forms an image on the paper P having been stacked on the paper stacker 100.

The image forming section 210 includes a fixing device 220, a printing section 230, a toner replenishment device 240, an ejection section 250, and a conveyance section 260. The conveyance section 260 conveys the topmost paper P of the paper P stacked on the paper stacker 100 on a sheet-by-sheet basis sequentially. The printing section 230 prints an image on the paper P with toner supplied from the toner replenishment device 240. The fixing device 220 fixes the image printed by the printing section 230 to the paper P. The conveyance section 260 ejects the paper P to which the image is fixed to the ejection section 250. The elements of the image forming section 210 will be described later in detail.

Figure 2A:
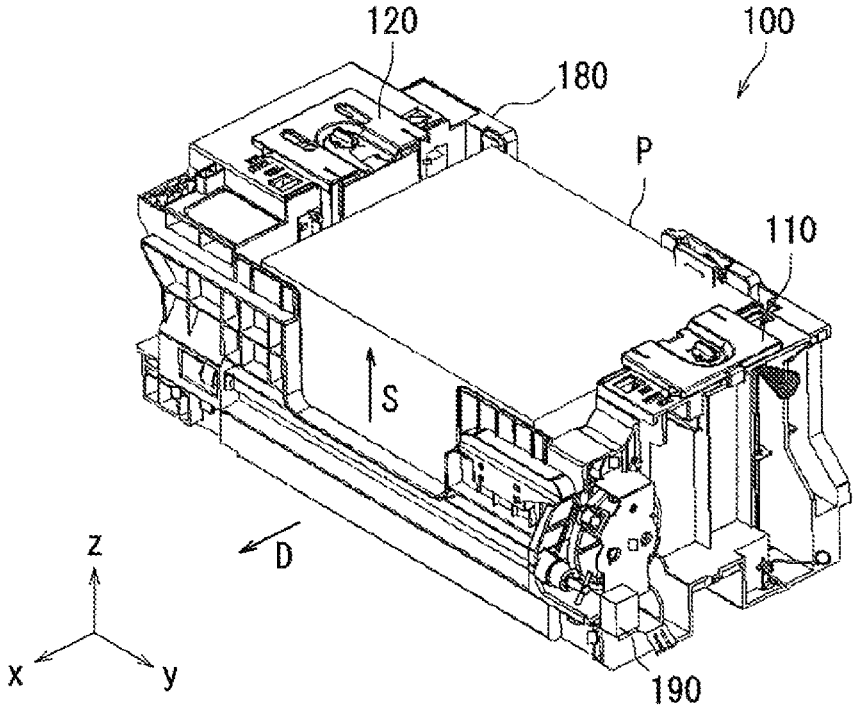
FIGS. 2A and 2B are schematic perspective views showing a paper stacker according to an embodiment of the present disclosure.
Figure 2B:
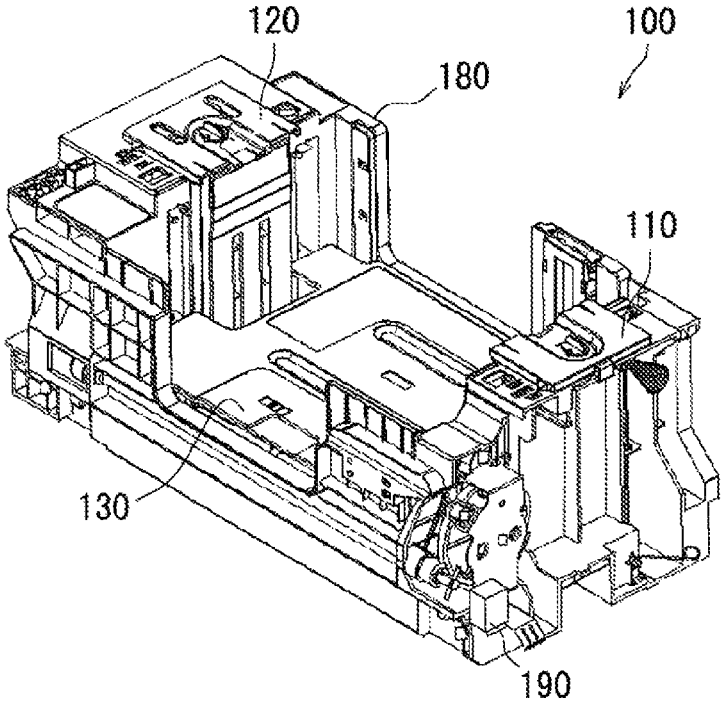

With reference to FIGS. 2A and 2B, the paper stacker 100 according to the present embodiment will be described now. FIGS. 2A and 2B are schematic perspective views of the paper stacker 100. FIG. 2A shows the paper stacker 100 on which plural sheets of paper P are stacked. While on the other hand, FIG. 2B shows the paper stacker 100 on which no paper P is stacked. The paper P is rectangular in shape. Here, the paper P is stackable in a fashion that its long and short sides are in parallel to the y and x directions, respectively. Plural sheets of paper P are stacked on the paper stacker 100 in a stacking direction S in parallel to the z direction orthogonal to the x and y directions.

The paper stacker 100 in the present embodiment includes a pair of side fences 110 and 120 and a lift plate 130. The side fence 110 faces the side fence 120. The paired side fences 110 and 120 regulate the position of the paper Pin the width direction (the y direction orthogonal to a paper conveyance direction D).

The side fences 110 and 120 are arranged correspondingly to the respective central regions of the short sides of the paper P. The side fences 110 and 120 are mounted to face each other in a hollow casing 180. In the following description, the side fences 110 and 120 may be referred to as first and second side fences, respectively.

The position of the paper P is regulated by the first and second side fences 110 and 120. The distance between the side fences 110 and 120 is changeable according to the size of to-be-stacked paper P.

The lift plate 130 is capable of moving the paper P up to a paper feed point along the side fences 110 and 120. The lift plate 130 is accommodated in the casing 180. The lift plate 130 is capable of lifting up and down in the z direction the paper P regulated by the side fences 110 and 120.

The main surface of the lift plate 130 is rectangular in shape having rectangle notches in the middle of the respective short sides. When viewing the main surface of the lift plate 130 in the normal direction, the lift plate 130 is in an H-shape. The side fences 110 and 120 are arranged correspondingly to the respective rectangular notches of the lift plate 130. The lift plate 130 is capable of moving up and down between the bottom point and the paper feed point along the side fences 110 and 120 in a state in which the paper P is stacked thereon.

The normal rotation of a drive motor 190 moves up the lift plate 130 along the first and second side fences 110 and 120. For example, the lift plate 130 moves up from the bottom point until the topmost paper p reaches the paper feed point. In reverse, the reverse rotation of the drive motor 190 moves down the lift plate 130 along the first and second side fences 110 and 120. For example, the lift plate 130 moves down from the paper feed point to the bottom point.

During the time when the paper stacker 100 is in a standby state, the lift plate 130 is located at the bottom point. When the paper stacker 100 is changed from the standby state to a paper conveyance start-up state, for example, when the image forming apparatus 300 is changed from the standby state to a printable state, the lift plate 130 moves up from the bottom point to the paper feed point. When the paper stacker 100 is change from the paper conveyance start-up state to the standby state, for example, when the image forming apparatus 300 is changed from the printable state to the standby state, the lift plate 130 moves down from the paper feed point to the bottom point.

The topmost paper P is lifted up to the paper feed point by the lift plate 130 in the paper stacker 100, and then conveyed in the paper conveyance direction D parallel to the x direction at the paper feed point. Note that the point of the lift plate 130 when the topmost paper P is at the paper feed point depends on the number of sheets of paper P stacked on the lift plate 130. For example, when the topmost paper P is at the paper feed point in a state in which a comparatively small number of sheets of paper P are stacked, the point of the lift plate 130 is comparatively high. In reverse, in a state in which a comparatively large number of sheets of paper P are stacked, the point of the lift plate 130 is comparatively low.

A paper pickup 262 shown in FIG. 1 conveys the paper P stacked on the paper stacker 100 in the conveyance direction D shown in FIG. 2A. The operation of the paper pickup 262 will now be described with reference again to FIGS. 1, 2A, and 2B.

The conveyance section 260 includes the paper pickup 262. The paper stacker 100 raises the lift plate 130 until the topmost paper P comes in contact with the paper pickup 262. The paper pickup 262 conveys the topmost paper P on a sheet-by-sheet basis. When the paper P is lifted up further, thereby changing the position of the paper pickup 262, the paper stacker 100 stops raising the lift plate 130.

The paper pickup 262 includes a pickup roller 262*a*, a conveyance roller 262*b*, an unravelling roller 262*c*, a support member 262*d*, a light shielding member 262*e*, and an optical sensor 262*f*. The support member 262*d* supports the pickup roller 262*a*, the conveyance roller 262*b*, and the light shielding member 262*e*. The support member 262*d* is rotatable about the rotation axis of the conveyance roller 262*b*.

The topmost paper P is picked up by the pickup roller 262*a* on a sheet-by-sheet basis and sent to the conveyance roller 262*b* and the unravelling roller 262*c*. Then, the paper P is sent to other elements of the conveyance section 260 by the conveyance roller 262*b* and the unravelling roller 262*c*.

The optical sensor 262*f* detects the position of the topmost paper P in cooperation with the light shielding member 262*e*. The optical sensor 262*f* includes a light emitting section and a light receiver. The optical sensor 262*f* detects whether or not the topmost paper P reaches a predetermined point according to whether or not the light shielding member 262*e* shields the light path between the light emitting section and the light receiving section.

During the time when the topmost paper P is out of contact with the pickup roller 262*a*, the light shielding member 262*e* does not shield the light path in the optical sensor 262*f*. Accordingly, it is detected that the topmost paper P does not reach the paper feed point in the paper stacker 100.

By contrast, when the topmost paper P comes in contact with the pickup roller 262*a* to slightly rotate the pickup roller 262*a* and the support member 262*d* about the rotation axis of the conveyance roller 262*b*, the light shielding member 262*e* is raised together with the support member 262*d* to shield the light path in the optical sensor 262*f*. Accordingly, it is detected that the topmost paper P reaches the preset point. In other words, the positional relationship between the optical sensor 262*f* and the light shielding member 262*e* determines the preset point. Any other scheme may be employable as long as it can be detected that the topmost paper P reaches the preset point.

Figure 3A:
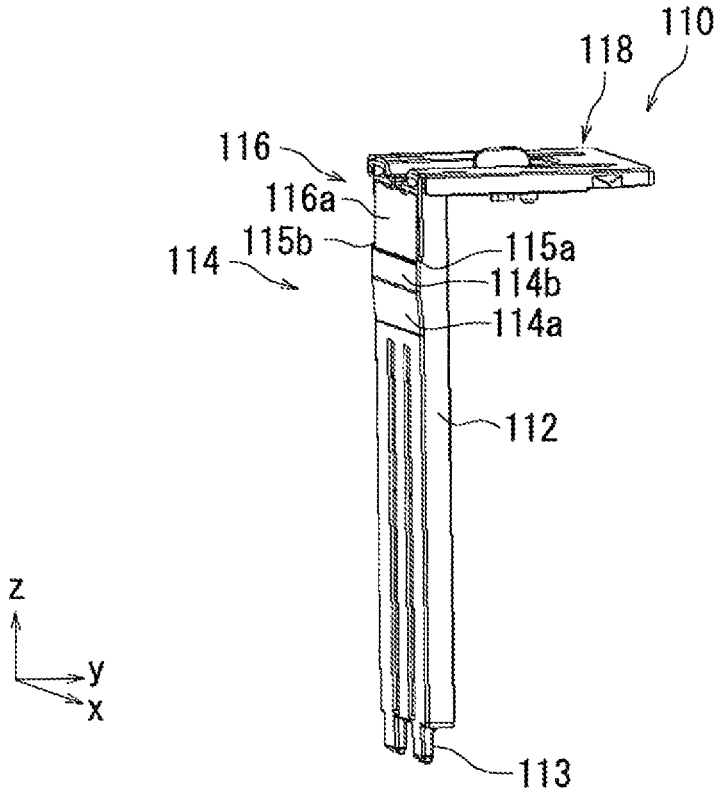
FIG. 3A is a schematic perspective view of one of side fences in the paper stacker according to the embodiment.
Figure 3B:
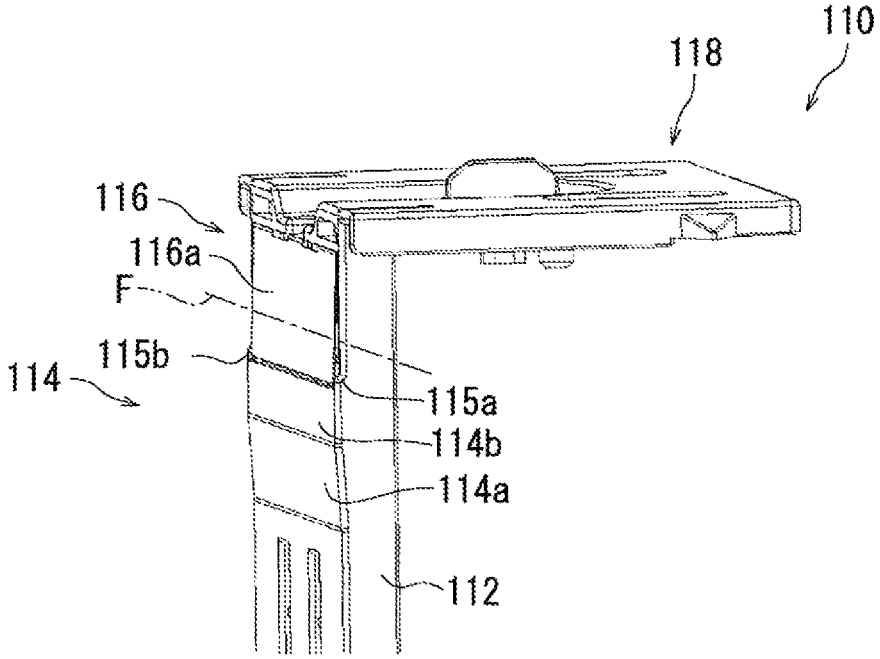
FIG. 3B is a partial enlarged view of FIG. 3A.
Figure 4:
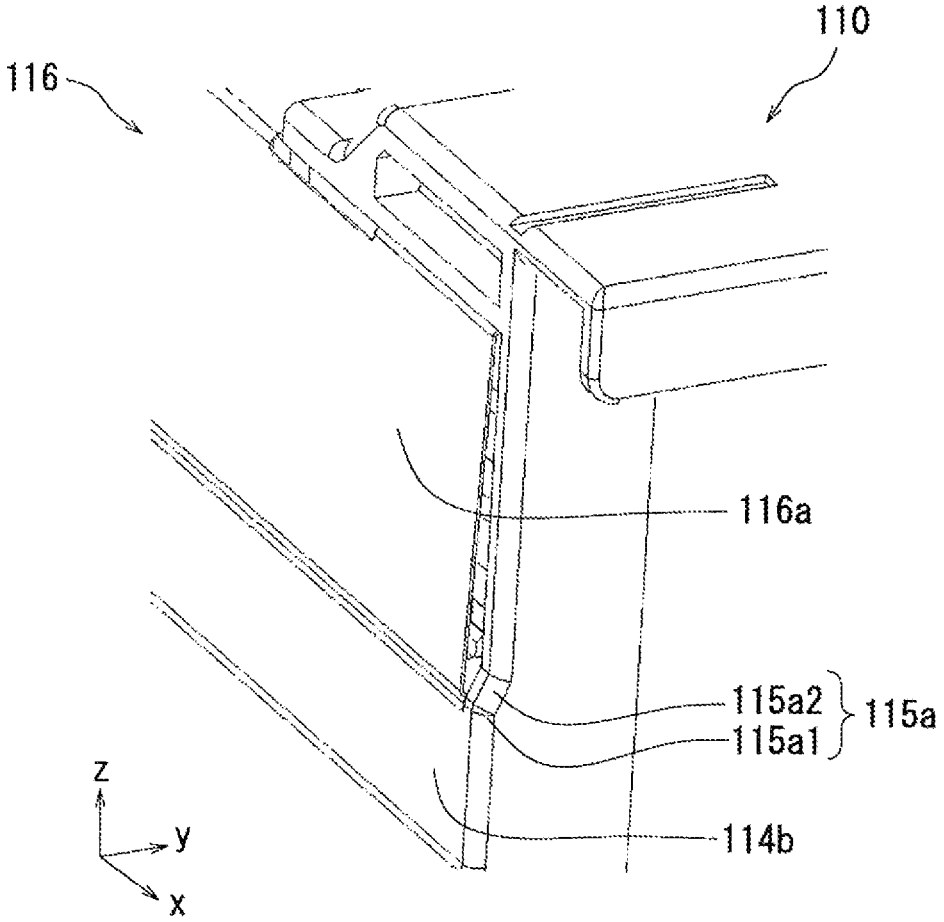
FIG. 4 is a schematic perspective view of the side fence of the paper stacker according to the embodiment.

With reference to FIGS. 2A-4, the first side fence 110 of the paper stacker 100 will be described below. FIG. 3A is a schematic perspective view of the first side fence 110. FIG. 3B is a partially enlarged view of FIG. 3A FIG. 4 is a schematic perspective view showing the vicinity of the boundary between a swell segment 114 and an urging segment 116 of the first side fence 110 in an enlarged scale.

The first side fence 110 includes a main body 112, the swell segment 114, the urging segment 116, and a horizontal segment 118. Here, the main body 112 has a flat surface, and the swell segment 114 is made from the same member as the main body 112. For example, the swell segment 114 is integrally formed with the main body 112. Protruding portions 113 are formed at the lower part of the main body 112. The protruding portions 113 fit in slits (not shown) formed in the bottom plate of the casing 180. The main body 112 extends in the z direction, while the horizontal segment 118 extends in the y direction orthogonal to the z direction. The horizontal segment 118 is secured to the casing 180.

The main body 112 defines a reference plane R (see FIGS. 6A-6D) of the side fence 110. The swell segment 114 swells from the reference plane defined by the main body 112. For example, the swell segment 114 swells 0.5 mm from the reference plane in the y direction and defines a regulation plane G (see FIGS. 6A-6D) for regulation of the paper P.

The swell segment 114 swells from the main body 112 toward the edge of the paper P below the paper feed point F. Here, the swell segment 114 includes an inclining segment 114*a* and a regulating segment 114*b*. The regulating segment 114*b* has a flat surface parallel to the main body 112. The end on the bottom side of the regulating segment 114*b* is connected to the inclining segment 114*a*. The length of the inclining segment 114*a* is almost equal to that of the regulating segment 114*b* in the x direction.

The inclining segment 114*a* is sloping. The length (thickness) of the inclining segment 114*a* in the y direction is smaller than that in the z direction so as to form a gentle gradient of the inclining segment 114*a*. Note that the regulation plane G (see FIGS. 6A-6D) is defined by the regulating segment 114*b* of the swell segment 114.

Ribs 115*a* and 115*b* are formed at the respective upper edges of the regulating segment 114*b*. For example, the ribs 115*a* and 115*b* are made from the same material as the regulating segment 114*b*. Favorably, the ribs 115*a* and 115*b* are integrally formed with the regulating segment 114*b*. The ribs 115*a* and 115*b* protrude from the respective edges of the regulating segment 114*b* along the respective sides of the urging segment 116 toward the paper feed point F indicative of the height level where the paper P is to be fed. The lower end part of the urging segment 116 is located between the ribs 115*a* and 115*b*. The ribs 115*a* and 115*b* on top of the regulating segment 114*b* can prevent the paper P from entering between the regulating segment 114*b* and the urging segment 116.

As can be understood from FIG. 3B, the paper feed point F is defined in the region where the urging segment 116 is provided. Here, the urging segment 116 is a plate spring. For example, the urging segment 116 is made of stainless steel. The opposite end parts of the urging segment 116 extend in parallel to the stacking direction S (see FIG. 2A) similarly to the opposite end parts of the main body 112.

The urging segment 116 in the present embodiment is made from a metal. The urging segment 116 has an urging surface portion 116*a* above the swell segment 114. A part of the surging surface portion 116*a* is located between the swell segment 114 and the paper feed point F. The urging surface portion 116*a* is movable toward the edge of the paper P. When the paper P moves in the y direction and comes in contact with the urging surface portion 116*a* around the paper feed point F, the urging segment 116 exerts an urging force to move back the paper P.

Here, the top of the urging surface portion 116*a* is located on the reference plane R (see FIGS. 6A-6D) of the side fence 110 in the y direction, while the lower part thereof is located on the regulation plane G (see FIGS. 6A-6D) of the swell segment 114 in the y direction. As described above, the swell segment 114 swells from the reference plane R of the side fence 110. The urging surface portion 116*a* of the urging segment 116 is positioned between the reference plane R defined by the main body 112 and the regulation plane G defined by the swell segment 114.

Note that the rib 115*a* includes an extension portion 115*a*1 and a connecting portion 115*a*2, as shown in FIG. 4. The extension portion 115*a*1 extends from the regulating segment 114*b* in the stacking direction S (see FIG. 2A). The extension portion 115*a*1 has a flat surface continuing to the flat surface of the regulating segment 114*b*. The connecting portion 115*a*2 has an inclining surface inclining relative to the flat surface of the extension portion 115*a*1. The paper P being lifted up is guided along the regulating segment 114*b* of the swell segment 114 and the extension portion 115*a*1. A gap lies between the regulating segment 114*b* and the urging segment 116 in the central region in the x direction of the side fence 110. The extension portion 115*a*1 can prevent the paper P from entering into the gap between the regulating segment 114*b* and the urging segment 116.

Note that the inclination of the connecting portion 115*a*2 is larger than that of the urging surface portion 116*a* relative to the regulation plane G (see FIGS. 6A-6D). Accordingly, the paper P moving in the y direction above the extension portion 115*a*1 can come in contact with the urging surface portion 116*a* without contact with the connecting portion 115*a*2. Thus, even when the paper P moves in the y direction at the paper feed point F, such movement can be regulated, and the paper P can be returned to the proper position.

Further, as can be understood from FIGS. 3B and 4, comparatively small inclination of the inclining segment 114*a* relative to the reference plane R of the side fence 110 can attain gradual regulation of the paper P as the paper P is lifted up. Thus, the paper P can be more positively regulated in position while being prevented from warping.

The second side fence 120 has a similar configuration to that of the first side fence 110 in the paper stacker 100 of the present embodiment. The configuration of the second side fence 120 will be briefly described below with reference to FIGS. 5A and 5B.

Figure 5A:
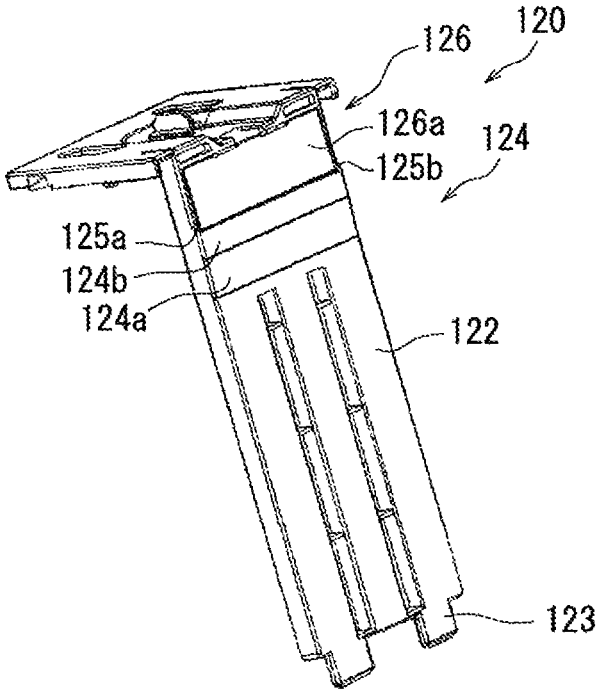
FIG. 5A is a perspective view of the other side fence in the paper stacker according to the embodiment.
Figure 5B:
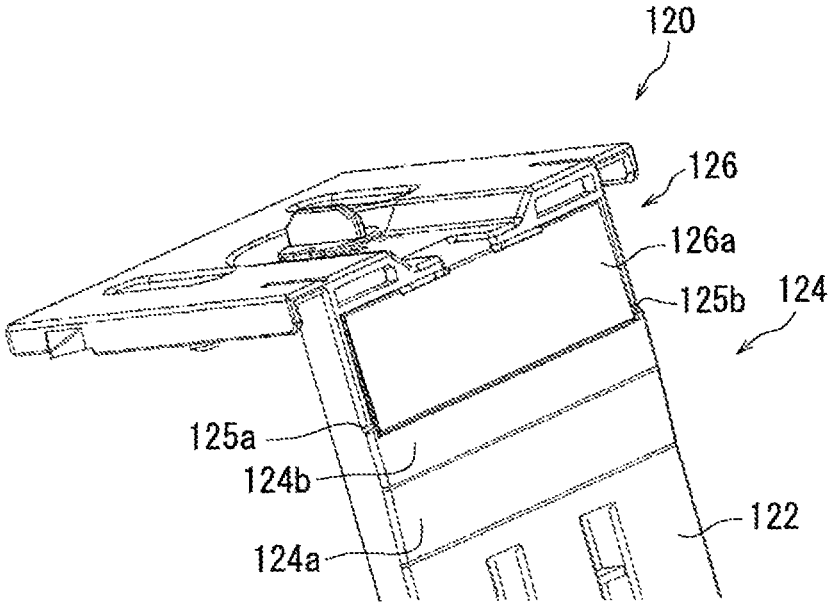
FIG. 5B is a partial enlarged view of FIG. 5A.

FIG. 5A is a schematic perspective view of the second side fence 120. FIG. 5B is a partially enlarged view of FIG. 5A. The second side fence 120 includes a main body 122, a swell segment 124, and an urging segment 126. Here, the main body 122 has a flat surface, and the swell segment 124 swells from the flat surface of the main body 122. The swell segment 124 includes an inclining segment 124*a* and a regulating segment 124*b*. Ribs 125*a* and 125*b* are formed at the respective upper edges of the regulating segment 124*b*. The urging segment 126 has an urging surface portion 126*a* above the swelling segment 124. A part of the urging surface portion 126*a* is located between the swell segment 124 and the paper feed point F. Protruding portions 123 are formed at the lower part of the main body 122. The protruding portions 123 engage with slits (not shown) formed in the bottom plate of the casing 180 (see FIGS. 2A and 2B).

The side fences 110 and 120 are separate from the paper stacker 100 in FIGS. 3A-5B. Whereas, as understood from FIGS. 2A-5B, the distance between the main body 112 of the side fence 110 and the main body 122 of the side fence 120 is wider than that between the swell segment 114 of the side fence 110 and the swell segment 124 of the side fence 120. In the case of, for example, A4-size paper P that is 210 mm wide and 297 mm long, the distance between the main body 112 of the side fence 110 and the main body 122 of the side fence 120 is set to be 298 mm, while the distance between the swell segment 114 of the side fence 110 and the swell segment 124 of the side fence 120 is 297 mm.

The state of regulation on the paper P being lifted up by the paper stacker 100 varies. This will be described now with reference to FIGS. 6A-6D. Since the side fence 110 has the similar configuration to that of the side fence 120 in the paper stacker 100, as described above, only the side fence 110 is shown in FIGS. 6A-6D.

As shown in FIGS. 6A-6D, the paper P is lifted up until the topmost paper P reaches the paper feed point F. Here, the main body 112 defines the reference plane R of the side fence 110, while the regulating segment 114*b* defines the regulation plane G. The urging surface portion 116*a* at the paper feed point F is located between the reference plane R defined by the main body 112 and the regulation plane G defined by the regulating segment 114*b* in the width direction of the paper. The urging surface portion 116*a* is movable toward the edge of the paper P within the range between the reference plane R and the regulation plane G.

Figure 6A:
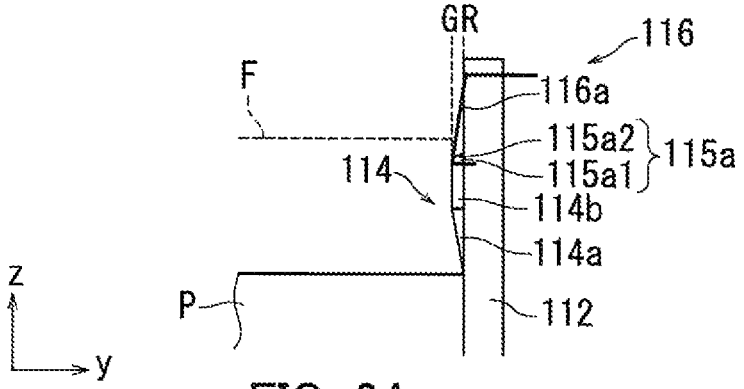
FIGS. 6A-6D are schematic side views showing the vicinity of one of the side fences when stacked paper is lifted up in the paper stacker according to the embodiment.

As shown in FIG. 6A, until the topmost paper P reaches the swell segment 114 of the side fence 110, the main body 112 regulates the paper P. In so doing, play for the paper P is comparatively large, and the side fence 110 regulates the paper P not so positively. Therefore, the paper P can move in the y direction to some extent.

Figure 6B:
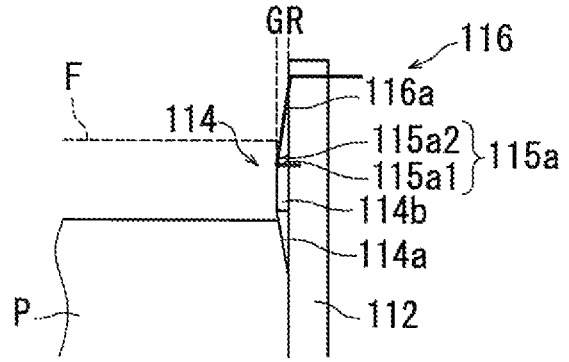

As shown in FIG. 6B, when the topmost paper P is lifted up further and reaches the inclining segment 114*a* of the swell segment 114, the play for the paper P in contact with the swell segment 114 gradually decreases. As the paper P is lifted up along the inclining segment 114*a* of the swell segment 114, the movable range of the paper P decreases. When the paper P reaches the regulating segment 114*b* of the swell segment 114, the play for the paper P less remains.

Figure 6C:
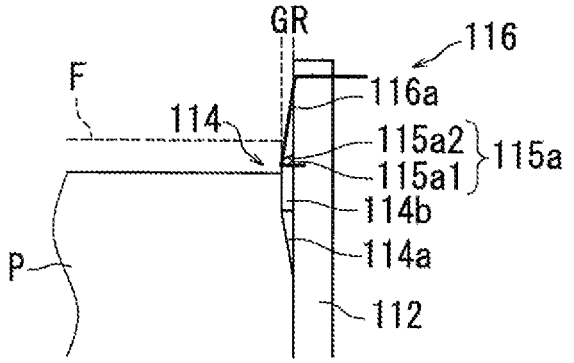

As shown in FIG. 6C, when the topmost paper P is further lifted up and reaches the regulating segment 114*b* of the swell segment 114, the regulating segment 114*b* regulates the paper P. Where the error in length in the width direction (the y direction) of the paper P is comparatively large and/or where the paper P is stacked in a skewed manner, the regulating segment 114*b* regulates the paper P comparatively positively.

Figure 6D:
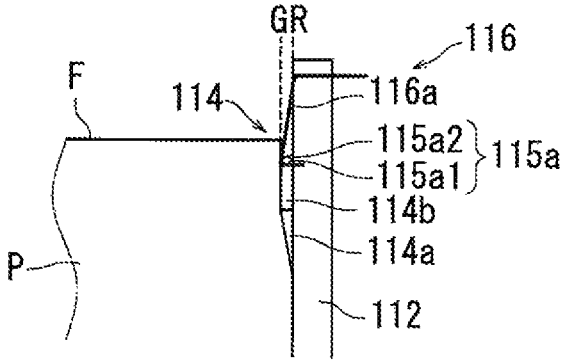

As shown in FIG. 6D, when the topmost paper P is still lifted up over the regulating segment 114*b* of the swell segment 114 and the extension portion 115*a*1 in the side fence 110, the regulation on the paper P is slightly relaxed. As can be understood from FIG. 6D, when paper P containing less error in length in the width direction (the y direction) is lifted up to the paper feed point F ideally, the urging surface portion 116*a* is out of contact with the paper P. By contrast, paper P containing a comparatively large error in length in the width direction (the y direction) and/or stacked in a skewed manner comes into contact with the urging surface portion 116*a* of the urging segment 116. In such a situation, the paper P moves toward the reference plane R to push the urging surface portion 116*a*. However, the pushed urging surface portion 116*a* urges back the edge of the paper P in the y direction, thereby keeping in contact with the paper P. Note that the urging surface portion 116*a* tends to be rubbed by the paper P, and therefore, is preferably made from a metal such as stainless steel.

As described above, in the present embodiment, the urging surface portion 116*a* slightly retracts in the y direction from paper P above the swell segment 114. Accordingly, even the paper P above the swell segment 114 moving in the y direction toward the side fence 110 comes in contact with the urging surface portion 116*a*. In such a situation, the urging segment 116 urges the paper P at the paper feed point F to return the paper P to the proper position.

Note that it is preferable that the distance between the regulation plane G and the urging surface portion 116*a* at the paper feed point F is comparatively small. For example, the distance between the regulation plane G and the urging surface portion 116*a* is preferably 0.2 mm or less.

It is also preferable that several sheets of paper P are present between the top level of the extension portion 115*a*1 of the swell segment 114 and the paper feed point F. For example, the number of sheets of paper P presentable between the top level of the extension portion 115*a*1 and the paper feed point F is preferably two or three. In this case, the urging segment 116 only urges the several sheets of paper P located over the top level of the extension portion 115*a*1. Accordingly, even a slight force that the urging segment 116 exerts can prevent paper feed failure.

Figure 7A:
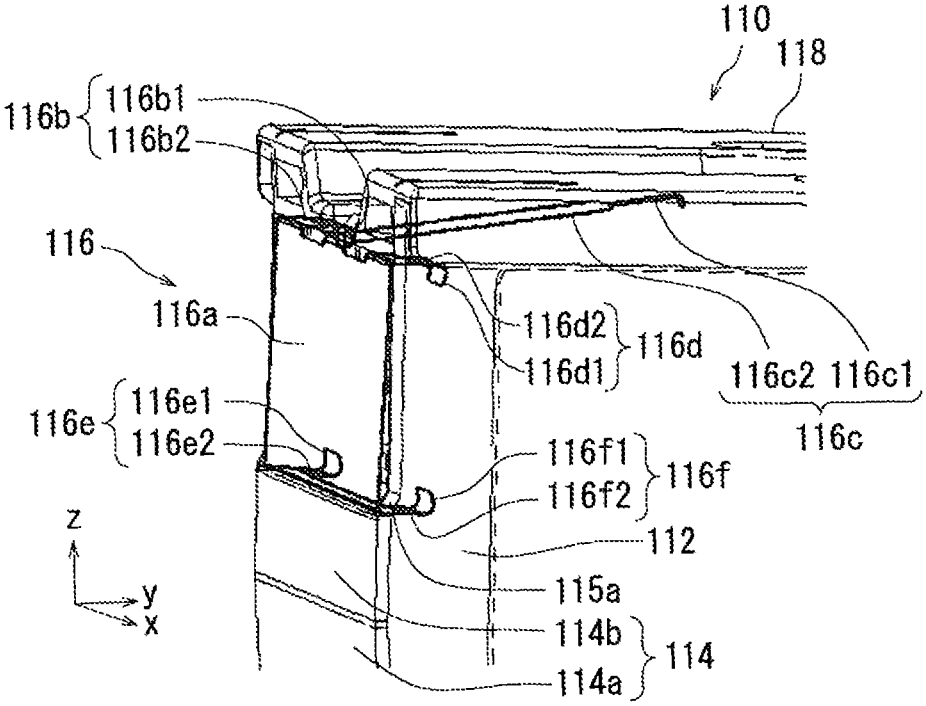
FIGS. 7A and 7B are a schematic perspective view and a schematic side view of the one side fence of the paper stacker according to the embodiment, respectively.
Figure 7B:
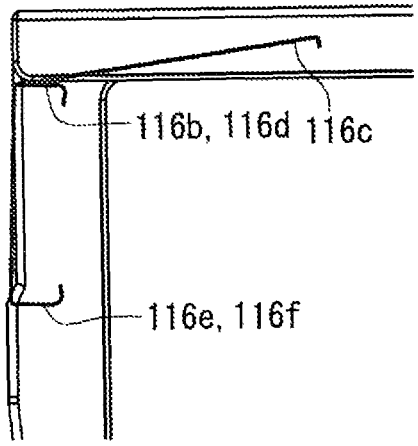

The configuration of the urging segment 116 of the side fence 110 will now be described with reference to FIGS. 7A and 7B. FIG. 7A is a schematic perspective view of the side fence 110. FIG. 7B is a schematic side view thereof.

The urging segment 116 includes the urging surface portion 116*a* and engaging pieces 116*b*, 116*c*, 116*d*, 116*e*, and 116*f*. The engaging pieces 116*b*, 116*c*, 116*d*, 116*e*, and 116*f* are connected to the urging surface portion 116*a* to extend from the reverse side of the urging surface portion 116*a*. The engaging pieces 116*b*, 116*c*, and 116*d* are formed on the top of the urging surface portion 116*a*, while the engaging pieces 116*e* and 116*f* are formed at the bottom of the urging surface portion 116*a*. The engaging pieces 116*b*, 116*c*, 116*d*, and 116*f* regulate the movable range of the urging surface portion 116*a* in the direction toward the edge of the paper P.

The urging surface portion 116*a* has an upper part secured to the main body 112 and the horizontal segment 118 and a lower part swingable in the y direction about the upper part. With this configuration, the lower part of the urging surface portion 116*a* swings in the y direction about the upper part. The engaging pieces 116*b* and 116*d* are formed on the respective side ends of the upper part of the urging surface portion 116*a*. The engaging piece 116*c* is formed in the central region in the upper part of the urging surface portion 116*a*. The engaging pieces 116*e* and 116*f* are formed on the respective side ends of the lower part of the urging surface portion 116*a*.

The engaging piece 116*b* engages with the main body 112. The engaging piece 116*b* includes a claw 116*b*1 and an arm 116*b*2. The arm 116*b*2 connects the urging surface portion 116*a* to the claw 116*b*1. The claw 116*b*1 is hooked on the main body 112.

The engaging piece 116*c* engages with the horizontal segment 118. The engaging piece 116*c* includes a claw 116*c*1 and an arm 116*c*2. The arm 116*c*2 connects the urging surface portion 116*a* to the claw 116*c*1. The claw 116*c*1 of the engaging piece 116*c* is hooked on the horizontal segment 118. This can prevent the engaging piece 116*c* form falling off. The urging segment 116 is fitted in a manner that the urging surface portion 116*a* is pushed toward the engaging piece 116*c* so as to reduce the angle between the engaging piece 116*c* and the urging surface portion 116*a*. Thus, the urging surface portion 116*a* urges the paper P in the y direction.

The engaging pieces 116*d*, 116*e*, and 116*f* have the same configuration as the engaging piece 116*b*. Claws 116*d*1, 116*e*1, and 116*f*1 are hooked on the main body 112. The engaging pieces 116*b*, 116*d*, 116*e*, and 116*f* define the movable range of the urging segment 116 in the direction toward the paper edge. Note that the claws 116*b*1-116*f*1 and the arms 116*b*2-116*f*2 of the respective engaging pieces 116*b*-116*f* are formed by bending.

The image forming apparatus 300 will be described below with reference again to FIG. 1. The paper P is stacked on the paper stacker 100. The conveyance section 260 conveys plural sheets of paper P on a sheet-by-sheet basis. In copying, the paper P stacked on the paper stacker 100 is conveyed by the conveyance section 260 via the printing section 230 and the fixing device 220 and ejected from the ejection section 250.

The printing section 230 forms a toner image on the paper P. The printing section 230 includes a photosensitive member 231, a developing device 232, and a transfer device 233. An electrostatic latent image is formed on the photosensitive member 231 by a laser based on electronic signals of an original image read by the image reading device 310. The developing device 232 includes a development roller 232*a*. The development roller 232*a* supplies toner to the photosensitive member 231 to develop the electrostatic latent image, thereby forming a toner image on the photosensitive member 231. The toner is replenished from the toner replenishment device 240 to the developing device 232. The transfer device 233 transfers the toner image formed on the photosensitive member 231 to the paper P.

A fixing member 221 and a pressure member 222 of the fixing device 220 applies heat and pressure to the paper P to melt the toner image formed and remaining unfixed yet in the printing section 230 and fix it to the paper P. In this manner, the image forming apparatus 300 forms an image on the paper P.

Note that the ribs 115*a* and 115*b* are formed on the respective side edge of the upper part of the regulating segment 114*b* of the swell segment 114 in the above description, which however, should not be taken to limit the present disclosure. The regulating segment 114*b* may include either one of the ribs 115*a* and 115*b* as necessary.

Further, the ribs 115*a* and 115*b* are formed on the upper part of the regulating segment 114*b* of the swell segment 114 in the above description, which however, should not be taken to limit the present disclosure. The ribs 115*a* and 115*b* may not be necessarily formed. However, it is preferable that at least one of the ribs 115*a* and 115*b* is formed on the swell segment 114 in order to prevent the paper P from entering between the swell segment 114 and the urging segment 116.

The present disclosure is not limited to the above configuration in which the swell segment 114 is made from the same member as the main body 112. The swell segment 114 may be made from a member different from the main body 112.

The present disclosure is also not limited to the above configuration in which the engaging pieces 116*b*-116*f* include the claws 116*b*1-116*f*1 and the arm 116*b*2-116*f*2, respectively, and the claws 116*b*1-116*f*1 are hooked on the main body 112 or the horizontal segment 118. The engaging pieces 116*b*-116*f* may be arranged such that catches are provided to pass through holes formed in the respective arms 116*b*2-116*f*2 to allow the engaging pieces 116*b*-116*f* to move in the y direction along the main body 112 or the horizontal segment 118.

Furthermore, the present embodiment is not limited to the above configuration in which a part of the urging surface portion 116*a* of the urging segment 116 is located between the swell segment 114 and the paper feed point F, while the other part of the urging surface portion 116*a* is located above the paper feed point F. The urging surface portion 116*a* may be located entirely between the swell segment 114 and the paper feed point F. However, when the inclination toward the reference plane R of the side fence 110 is comparatively slight, the urging surface portion 116*a* can urge colliding paper P in a direction around the y direction, thereby regulating the position of the paper P further appropriately.

Still further, the present disclosure is not limited to the above configuration in which the side fence 110 includes the main body 112, the swell segment 114, and the urging segment 116, and the side fence 120 similarly includes the main body 122, the swell segment 124, and the urging segment 126. At least one of the swell segment 124 and the urging segment 126 can be dispensed with in the side fence 120. Alternatively, at least one of the swell segment 114 and the urging segment 116 can be dispensed with in the side fence 110. Provision of the swell segment and the urging segment at either one of the side fences 110 and 120 can achieve appropriate paper feeding.

Yet further, the present disclosure is not limited to the above configuration in which the paper stacker 100 includes a pair of the side fences 110 and 120 that defines the position in the width direction of the paper P. The paper stacker 100 may be provided with a single side fence 110 so that the side fence 110 regulates the position in the width direction of the paper P in combination with a side surface of the casing 180.

Figure 8:
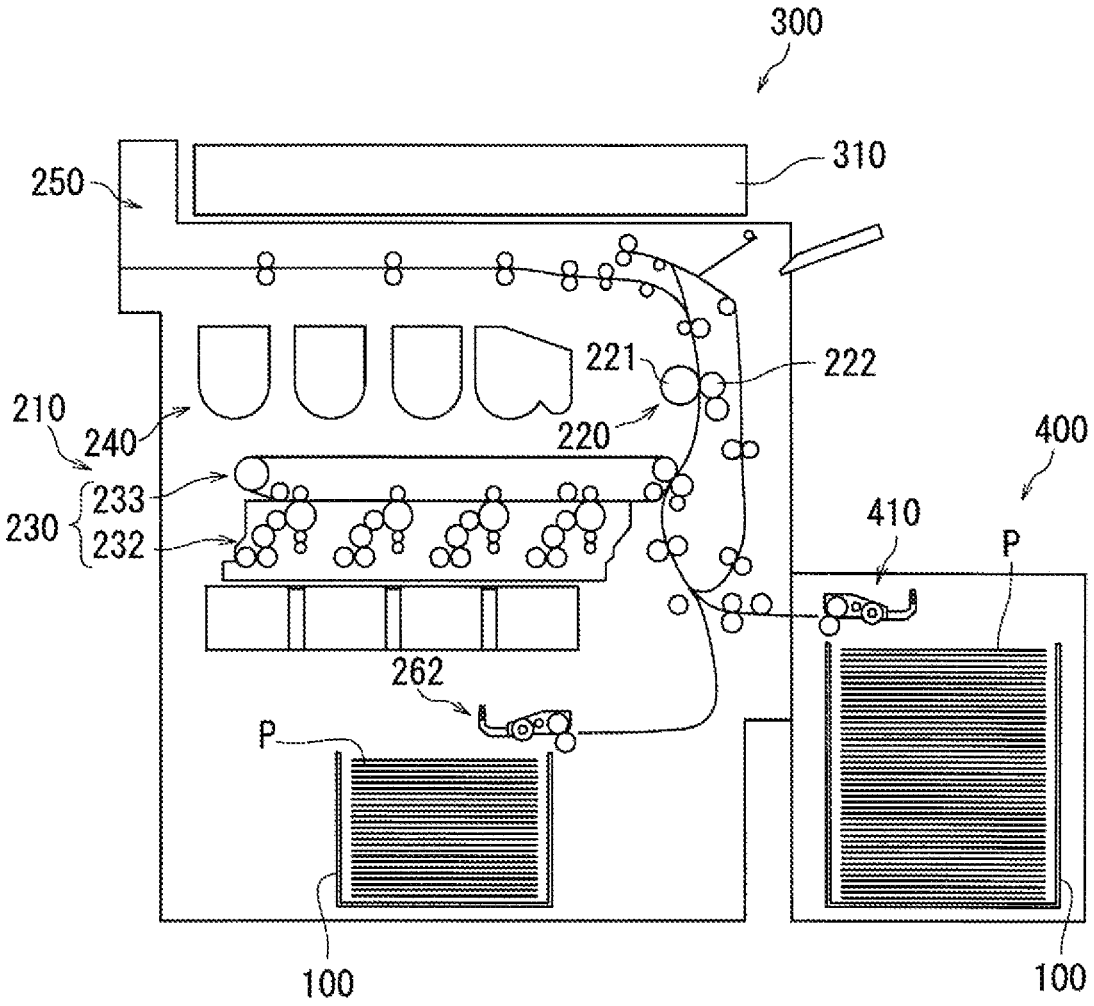
FIG. 8 is a schematic illustration showing a paper feeder including the paper stacker according to an embodiment.

In addition, as described with reference to FIG. 1, the paper stacker 100 is included in the image forming apparatus 300, which however, should not be taken to limit the present disclosure. As shown in FIG. 8, the paper stacker 100 may be included in a paper feeder capable of being installed in the exterior of the image forming apparatus 300.

FIG. 8 is a schematic illustration showing a paper feeder 400 including the paper stacker 100 according to the present embodiment. The paper feeder 400 is installed in the exterior of the image forming apparatus 300 and feeds paper P to the image forming apparatus 300. The paper feeder 400 includes the paper stacker 100 and a sheet supplier 410. The sheet supplier 410 supplies the topmost paper P of paper P stacked on the paper stacker 100 of the paper feeder 400 to the image forming apparatus 300 on a sheet-by-sheet basis. With this configuration, the image forming apparatus 300 can form an image on the paper P in the exterior as well as paper P accommodated in the interior.

What is claimed is:

1. A paper stacker on which paper is stackable in a stacking direction, comprising:

a casing;

a side fence extending in the stacking direction and configured to regulate a position in a width direction of the paper; and a lift plate capable of being loaded with the paper in the casing and moving the paper in parallel to a paper feed point in the stacking direction, wherein the side fence is mounted in the casing so as to be changeable in position according to a size of the paper that is loaded, the side fence includes a main body, a swell segment, and an urging segment, the main body defining a reference plane extending in the stacking direction, the swell segment being integral with the main body so as to be immovable relative to the main body and swelling from the reference plane toward an edge of the paper below the paper feed point, the urging segment including an urging surface portion above the swell segment, the urging surface portion being capable of moving toward the edge of the paper to be in contact with the edge of the paper so as to urge the edge of the paper at the paper feed point, and the swell segment includes a regulating segment parallel to the main body, and an inclining segment connecting the main body to the regulating segment below the regulating segment.

2. A paper stacker according to claim 1, wherein the side fence further includes ribs protruding along the respective ends in the stacking direction of the urging segment from respective ends of the regulating segment of the swell segment toward the paper feed point.

3. A paper stacker according to claim 2, wherein the ribs each include an extension portion extending from the regulating segment in the stacking direction and a connecting portion connecting the extension portion to the main body.

4. A paper stacker according to claim 1, wherein the urging segment is made from a metal.

5. A paper stacker according to claim 4, wherein the urging segment is a plate spring.

6. A paper stacker according to claim 1, wherein the urging segment has an upper part secured to the main body, and the urging segment is swingable relative to the main body about the upper part secured to the main body.

7. A paper stacker according to claim 1, wherein the urging surface portion at the paper feed point is located between the reference plane and a regulation plane defined by the regulating segment in the width direction of the paper.

8. A paper stacker according to claim 1, wherein the urging segment further includes an engaging piece connected to the urging surface portion and configured to engage with the main body, the engaging piece regulating a movable range of the urging surface portion in a direction toward the edge of the paper.

9. An image forming apparatus, comprising:

a paper stacker according to claim 1; and an image forming section configured to form an image on the paper having been stacked on the paper stacker.

10. A paper stacker on which paper is stackable in a stacking direction, comprising:

a side fence extending in the stacking direction and configured to regulate a position in a width direction of the paper; and a lift plate capable of moving the paper to a paper feed point, wherein the side fence includes a main body, a swell segment, and an urging segment, the swell segment swelling from the main body toward an edge of the paper below the paper feed point, the urging segment including an urging surface portion above the swell segment, the urging surface portion being capable of moving toward the edge of the paper to be in contact with the edge of the paper so as to urge the edge of the paper at the paper feed point, the swell segment includes a regulating segment parallel to the main body, and an inclining segment connecting the main body to the regulating segment below the regulating segment, and the urging surface portion at the paper feed point is located between a reference plane defined by the main body and a regulation plane defined by the regulating segment in the width direction of the paper.

11. A paper stacker according to claim 10, wherein the side fence further includes ribs protruding along the respective ends in the stacking direction of the urging segment from respective ends of the regulating segment of the swell segment toward the paper feed point.

12. A paper stacker according to claim 11, wherein the ribs each include an extension portion extending from the regulating segment in the stacking direction and a connecting portion connecting the extension portion to the main body.

13. A paper stacker according to claim 10, wherein the urging segment is made from a metal.

14. A paper stacker according to claim 13, wherein the urging segment is a plate spring.

15. A paper stacker according to claim 10, wherein the urging segment has an upper part secured to the main body, and the urging segment is swingable relative to the main body about the upper part secured to the main body.

16. A paper stacker according to claim 10, wherein the urging segment further includes an engaging piece connected to the urging surface portion and configured to engage with the main body, the engaging piece regulating a movable range of the urging surface portion in a direction toward the edge of the paper.

17. An image forming apparatus, comprising:

a paper stacker according to claim 10; and an image forming section configured to form an image on the paper having been stacked on the paper stacker.

* * * * *